US005366103A

United States Patent [19]

Abernathy et al.

[11] Patent Number: 5,366,103

[45] Date of Patent: Nov. 22, 1994

[54] SPILL-RESISTANT BOWL

[75] Inventors: Alexia Abernathy, Cedar Rapids, Iowa, by Terry J. Abernathy, guardian for minor; Keith D. Patterson, Providence, R.I.

[73] Assignee: Little Kids, Inc., East Providence, R.I. ; a part interest

[21] Appl. No.: 129,591

[22] Filed: Sep. 30, 1993

[51] Int. Cl.[5] ..... B65D 25/00

[52] U.S. Cl. ..... 220/23.83; 220/574

[58] Field of Search ..... 220/23.83, 23.86, 574, 220/574.1

[56] References Cited

U.S. PATENT DOCUMENTS

| | | | |
|---|---|---|---|
| 284,531 | 9/1883 | Berry | 220/574 X |
| 2,199,687 | 5/1940 | Blankenship | 220/23.86 X |
| 2,938,645 | 5/1960 | McCowan | 220/23.86 X |
| 3,469,682 | 9/1969 | Cline | 220/23.83 X |
| 4,117,948 | 10/1978 | Collins | 220/23.83 X |
| 4,351,164 | 9/1982 | Christiani | 220/23.83 X |
| 4,574,776 | 3/1986 | Hidle | 220/23.83 X |
| 5,184,745 | 2/1993 | Havens et al. | 220/23.83 |

*Primary Examiner*—Steven M. Pollard

*Attorney, Agent, or Firm*—Salter & Michaelson

[57] ABSTRACT

A spill-resistant bowl consists of a larger diameter outer bowl, a smaller diameter inner bowl Which is releasably and concentrically mounted inside the outer bowl, and an annular cover which is received around the top of the outer bowl. The inner bowl is operative for receiving food, such as milk and cereal, and the central opening of the annular cover allows the user to remove the food from the inner bowl. If the bowl is abruptly moved during use so as to cause the liquid in the inner bowl to rise up and spill over the edge of the inner bowl, the liquid is deflected downwardly by the annular cover into the surrounding outer bowl.

9 Claims, 1 Drawing Sheet

SPILL-RESISTANT BOWL

BACKGROUND AND SUMMARY OF THE INVENTION

The instant invention relates to eating bowls and more particularly to a bowl which prevents liquids from spilling or sloshing out of the bowl when the bowl is abruptly moved about.

It is well known that young children, for example children under the age of 4, do not have a well developed sense of hand-eye coordination. Consequently, young children tend to spill foods and liquids from their bowls and cups when they eat or drink. The lack of hand-eye coordination is particularly noticeable when children eat cereal and milk out of a bowl, because they almost always spill the milk and the cereal over the sides of the bowl while eating.

The instant invention provides a novel bowl which prevents liquids from spilling or sloshing out of the bowl when the bowl is abruptly moved. Briefly, the bowl comprises a larger diameter outer bowl, a smaller diameter inner bowl which is releasably mounted inside the outer bowl, and an annular cover which is received around the top of the outer bowl. The inner bowl is operative for receiving food, such as milk and cereal, and the central opening of the annular cover allows the user to remove the food from the inner bowl. If the bowl is abruptly moved during use so as to cause the liquid in the inner bowl to rise up and spill over the edge of the inner bowl, the liquid is deflected by the annular cover into the surrounding outer bowl. Accordingly, any liquid which spills or sloshes over the sides of the inner bowl is captured by the outer bowl without spilling onto the supporting surface or onto the user of the bowl. The spill-resistant bowl further includes a second cover which is received over the opening in the annular cover so that an unused portion of food may be stored in the bowl for later use.

Accordingly, it is an object of the instant invention to provide an eating bowl which prevents liquids from spilling out of the bowl when the bowl is abruptly moved about.

It is another object to provide a spill-resistant bowl comprising an inner bowl which is releasably mounted inside a larger diameter outer bowl.

It is yet another object to provide a spill-resistant bowl having an annular cover which deflects moving liquids into a surrounding outer bowl.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
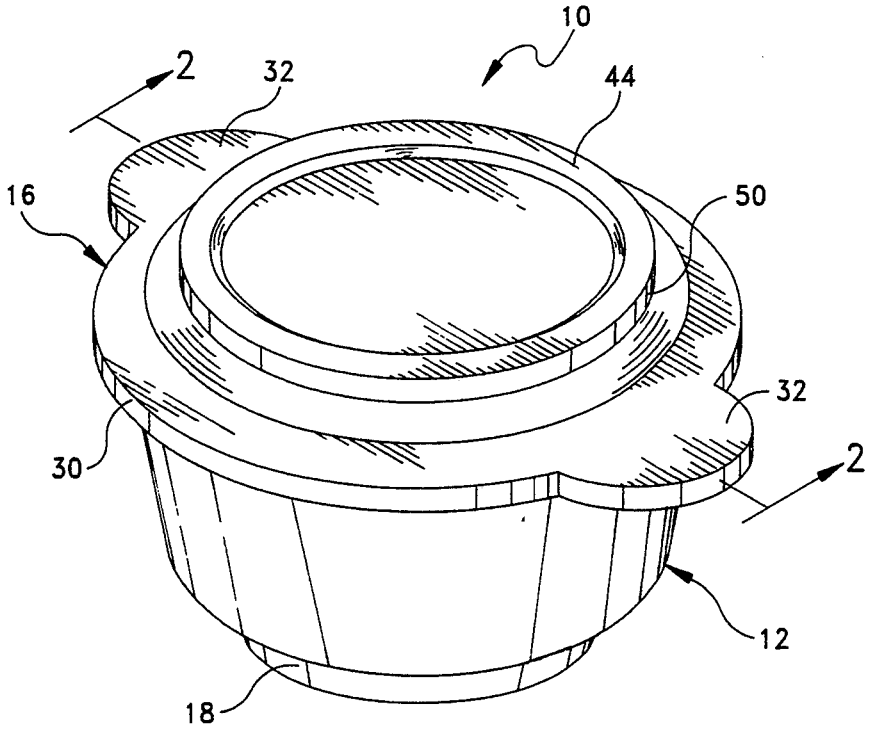
FIG. 1 is a perspective view of the instant spill-resistant bowl.
Figure 2:
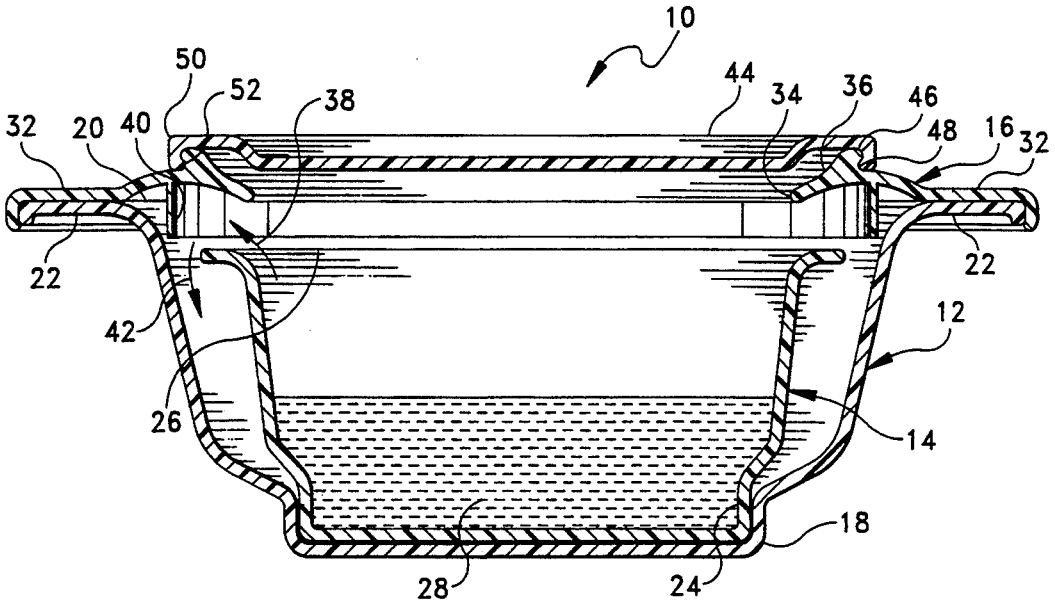
FIG. 2 is a cross-sectional view thereof taken along line 2—2 in FIG. 1.

Referring now to the drawings, the spill-resistant bowl of the instant invention is illustrated and generally indicated at 10 in FIGS. 1 and 2. As will hereinafter be more fully described, the instant bowl 10 is operative for preventing liquids from spilling or sloshing out of the bowl when the bowl is abruptly moved. The spill-resistant bowl 10 comprises a larger diameter outer bowl generally indicated at 12, a smaller diameter inner bowl generally indicated at 14 which is concentrically positioned in the outer bowl 12, and an annular cover generally indicated at 16 which is received over the outer bowl 12. The outer bowl 12 includes a circular base 18, an upper rim 20 and two wing-like extensions 22 on opposing sides of the rim 20. The wing-like extensions 22 on the outer bowl 12 facilitate grasping and handling of the bowl 10 by a young child. The inner bowl 14 also includes a circular base 24 and an upper rim 26, and it is operative for receiving liquid or pourable foods 28, such as cereal and milk, applesauce, soup, etc. It is pointed out that the outer diameter of the base 24 of the inner bowl 14 is slightly smaller than the inner diameter of the base 18 of the outer bowl so that the base 24 of the inner bowl 14 may be frictionally and releasably received into the base 18 of the outer bowl 12. (See FIG. 2). The friction fit of the circular bases 18 and 24 enables the bowls 12 and 14 to be easily assembled for use and disassembled for cleaning and storage. The upper rim 26 of the inner bowl 14 has a lesser height than the rim 20 of the outer bowl 12 so that liquid 28 which spills out of the inner bowl 14 is easily contained within the surrounding outer bowl 12. The annular cover 16 has an outer lip 30 (FIG. 1) which is releasably received onto the upper rim 20 of the outer bowl 12 with a friction fit as illustrated in FIG. 2. The annular cover 16 includes two wing-like extension 32 in order to fit over the rim extensions 22 on the outer bowl 12, and further includes a central opening 34 which is concentrically positioned over the inner bowl 14. The central opening 34 in the annular cover 16 has a slightly smaller diameter than the rim 26 of the inner bowl 14, and it enables the user to remove food 28 from the inner bowl 14. It is pointed out that the rim 36 which defines the central opening 34 is inclined downwardly so that food which is dropped from a spoon, or other eating utensil, is directed back into the inner bowl 14. Referring to FIG. 2, when the bowl 10 is abruptly moved so that the liquid 28 in the inner bowl 14 rises up and spills over the rim 26 (see arrow 38), the annular cover 16 is operative for deflecting the moving liquid 28 downwardly into the outer bowl 12. Accordingly, any liquid 28 which spills or sloshes over the rim 26 of the inner bowl 14 is captured by the outer bowl 12 without spilling onto the supporting surface or onto the user of the bowl 10. The annular cover 16 further includes a downwardly extending circular wall 40 which has a larger diameter than the inner bowl 14 and a smaller diameter than the outer bowl 12. The downwardly extending wall 40 is operative for further deflecting moving liquids 28 downwardly into the surrounding outer bowl 12. (See arrow 42).

The spill-resistant bowl 10 further includes a second cover 44 which is received over the central opening 34 in the annular cover 16 so that an unused portion of food 28 may be stored in the bowl 10 for later use. In this connection, the annular cover 16 further includes an ridge 46 which extends upwardly and encircles the central opening 34. The ridge 46 includes an outwardly facing groove 48. In order for the second outer cover 44 to form a friction tight fit, the rim 50 of the outer cover 44 includes an inwardly facing bead 52 which is received into the groove 48 when the cover 44 is fitted over the ridge 46.

It can therefore be seen that the instant invention provides a spill-resistant bowl 10 which effectively prevents liquids from spilling out of the bowl 10 when the bowl 10 is abruptly moved. The spill-resistant bowl 10 includes inner and outer concentric bowls 12 and 14, and an annular cover 16 which is operative for deflecting moving liquid 28 from the inner bowl 14 into the surrounding outer bowl 12-when the liquid 28 rises up and spills over the rim 26 of the inner bowl 14. The spill-resistant bowl 10 further includes an outer cover 44 which is received over the central opening 34 in the annular cover 16 so that an unused portion of food may be stored for later use. Still further, the inner and outer bowls 12 and 14 are releasably mounted together so that they may be easily assembled for use and disassembled for cleaning and storage. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A spill-resistant bowl comprising:

a larger diameter outer bowl;

a smaller diameter inner bowl which is substantially concentrically positioned inside said outer bowl, said inner bowl being operable for receiving a liquid therein;

means for releasably mounting said inner and outer bowls together; and an annular cover which is releasably received onto a rim portion of said outer bowl, said annular cover including a central opening that is substantially concentrically positioned over said inner bowl, said central opening having a smaller diameter than said inner bowl, said annular cover being operative for deflecting said liquid downwardly into said outer bowl when said liquid rises up and spills over the edge of the inner bowl.

2. The spill-resistant bowl of claim 1 further comprising an outer cover which is received over said central opening in said annular cover.

3. In the spill-resistant bowl of claim 1, said annular cover including a ridge which extends upwardly and encircles said central opening, said spill-resistant bowl further comprising an outer cover which is releasably received onto said ridge.

4. In the spill-resistant bowl of claim 1, said inner bowl having a lesser height than said outer bowl.

5. In the spill-resistant bowl of claim 1, said annular cover including a downwardly extending circular wall which has a larger diameter than said inner bowl and a smaller diameter than said outer bowl, said downwardly extending wall being operable for further deflecting said liquid downwardly into said outer bowl.

6. A spill-resistant bowl comprising:

a larger diameter outer bowl;

a smaller diameter inner bowl which is substantially concentrically positioned inside said outer bowl, said inner bowl being operable for receiving a liquid therein;

an annular cover which is releasably received onto a rim portion of said outer bowl, said annular cover including a central opening that is substantially concentrically positioned over said inner bowl, said central opening having a smaller diameter than said inner bowl, said annular cover being operative for deflecting said liquid downwardly into said outer bowl when said liquid rises up and spills over the edge of the inner bowl; and an outer cover which is received over said central opening in said annular cover.

7. In the spill-resistant bowl of claim 6, said annular cover including a ridge which extends upwardly and encircles said central opening, said outer cover being releasably received onto said upwardly extending ridge.

8. A spill-resistant bowl comprising:

a larger diameter outer bowl;

a smaller diameter inner bowl which is substantially concentrically positioned inside said outer bowl, said inner bowl being operable for receiving a liquid therein; and an annular cover which is releasably received onto a rim portion of said outer bowl, said annular cover including a central opening therein that is substantially concentrically positioned over said inner bowl, said central opening having a smaller diameter than said inner bowl, said annular cover being operative for deflecting said liquid downwardly into said outer bowl when said liquid rises up and spills over the edge of the inner bowl, said annular cover further including a downwardly extending circular wall which has a larger diameter than said inner bowl and a smaller diameter than said outer bowl, said downwardly extending wall being operable for further deflecting said liquid downwardly into said outer bowl.

9. In the spill-resistant bowl of claim 8, said inner bowl having a lesser height than said outer bowl.

* * * * *